United States Patent [19]

Napoleon

[11] 4,029,278

[45] June 14, 1977

[54] FOLDING STOOL WITH LEVELING LEG

[76] Inventor: Frank Napoleon, 902 Third Ave., Elizabeth, N.J. 07202

[22] Filed: June 21, 1976

[21] Appl. No.: 698,019

[52] U.S. Cl. ..... 248/188.2; 248/164; 297/56

[51] Int. Cl.[2] ..... H05B 1/00; A47C 13/00

[58] Field of Search ..... 248/188.2, 188.5, 188.4, 248/180, 163, 164, 431, 432, 166, 434, 435, 439, 148; 297/56, 57

[56] References Cited

UNITED STATES PATENTS

| | | | |
|---|---|---|---|
| 1,303,416 | 5/1919 | Tidyman | 248/188.5 X |
| 2,649,140 | 8/1953 | Housel | 248/431 |
| 2,984,444 | 5/1961 | Lewis | 248/166 |
| 3,122,397 | 2/1964 | Mintz | 248/164 X |
| 3,608,852 | 9/1971 | Horn | 248/166 |

FOREIGN PATENTS OR APPLICATIONS

| | | | |
|---|---|---|---|
| 898,070 | 10/1953 | Germany | 248/164 |

*Primary Examiner*—J. Franklin Foss
*Attorney, Agent, or Firm*—Jack D. Slobod

[57] ABSTRACT

A folding three legged stool includes first and second relatively pivoted members having generally parallel rails at their upper ends to which the ends of an elongated sheet are secured. The first member has two legs extending downward from opposite ends of its associated rail and the second member extends downward from its associated rail to a position between the legs where it is pivoted to the legs. The lower extreme of the second member carries a guide which slidably receives an extendable levelling leg having a series of apertures along its length. A clasp pivotly mounted on the guide includes a pin for projecting into a selected one of the apertures for levelling the stool.

1 Claim, 5 Drawing Figures

Fig. 1
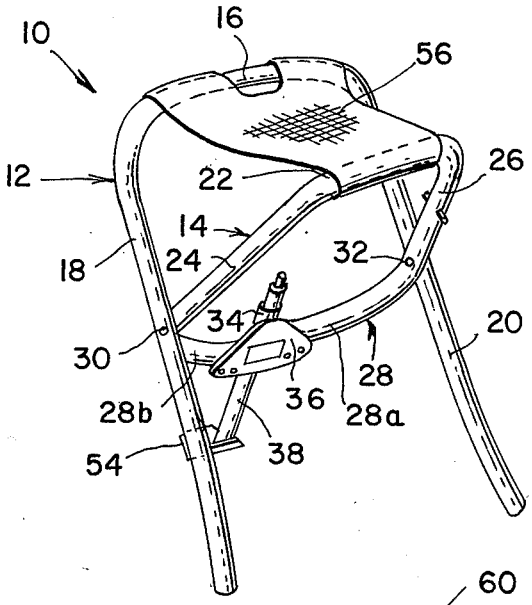
Fig. 3
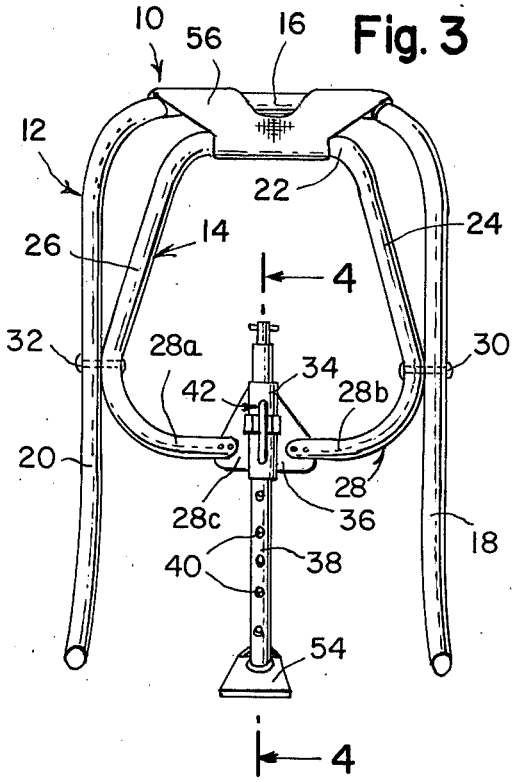
Fig. 5
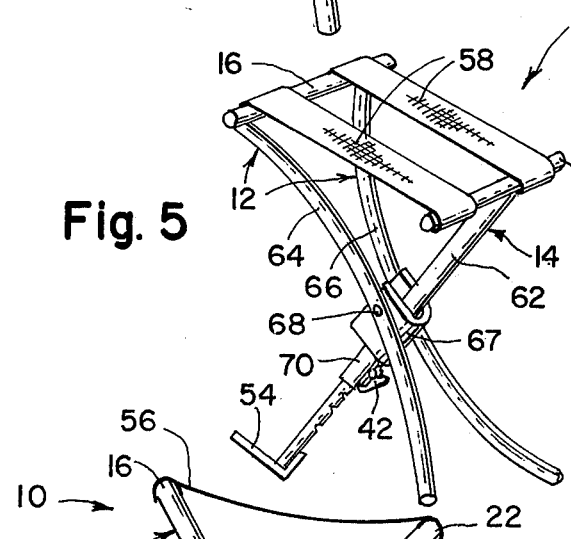
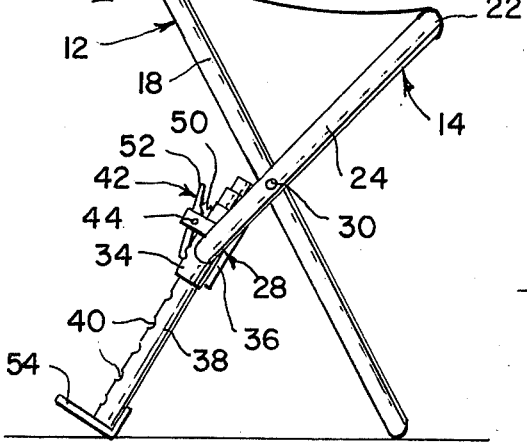
Fig. 2
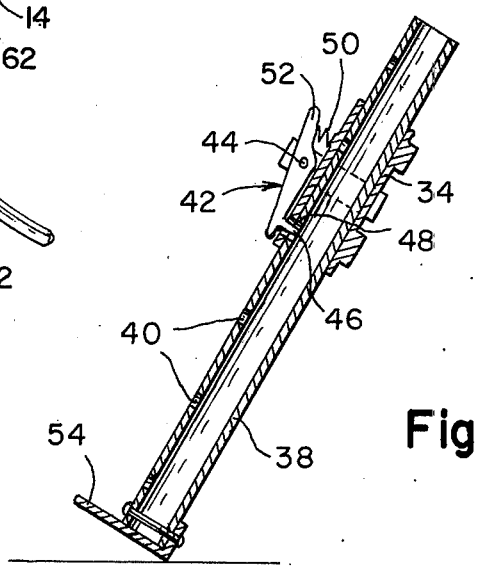
Fig. 4

FOLDING STOOL WITH LEVELING LEG

FIELD OF THE INVENTION

The present invention relates generally to a folding three legged stool including two relatively pivoted members, one carrying two legs and one carrying one leg. In its particular aspects the present invention relates to the provision of one leg of the stool as adjustable in effective length to enable levelling of the stool.

BACKGROUND OF THE INVENTION

It is desireable for hunters to carry a lightweight folding stool for use in quietly waiting for game to appear. While folding stools have heretofore been suggested for other purposes, such stools are not suitable for the purpose of the present invention because of the uneven terrain on which a hunting stool must be used. While various leg levelling devices have been heretofore provided for stools, these devices are cumbersome for use in the field. I am not aware of any previous folding stool which includes levelling legs and am also not aware of any three legged stool having only one levelling leg.

OBJECTS OF THE INVENTION

It is an object of the present invention to provide a folding three legged stool which includes a levelling leg means on one of the legs.

It is a further object of the present invention to provide a folding stool which may be quickly set up and levelled on a rough terrain.

SUMMARY OF THE INVENTION

Briefly, the aforementioned and other objects of the present invention are satisfied by providing a folding stool formed by a pair of relatively pivoted members. A first of the members has at its upper end a rail forming the rear edge of the stool. A pair of legs extend downwardly and forwardly from opposite ends of the rail. The second member has at its upper end a rail forming the front edge of the stool and the member extends downwardly and rearwardly to a position between the legs of the first member where it is pivoted to each of the legs. The second member has a lower extreme below the aforementioned position at which a downwardly and rearwardly projecting guide is provided for receiving extendable levelling leg having a plurality of apertures along its length.

A catch member is pivotly mounted to the guide and fixedly carries a pin for selective insertion into a selected one of the apertures in the extendable leg to enable levelling of the folding chair. A spring means applies a torque to the catch member for urging the pin into the aperture. For enabling the tubular leg to be slid in the guide for placing a different aperture in register with the pin, a torque portion of the catch means is provided for the application of finger pressure to overcome the torque of the spring means and rock the pin out of the aperture.

Other objects, features and advantages of the present invention will become apparent upon perusal of the following description of the preferred embodiments thereof when taken in conjunction with the appended drawing wherein:

FIG. 1 is a generally elevational pictorial presentation of the folding stool of the present invention;

FIG. 2 is a side elevational view of the stool in FIG. 1;

FIG. 3 is a rear elevational view of the stool in FIG. 1;

FIG. 4 is an enlarged cross-sectional elevational view taken through the lines 4—4 in FIG. 3; and FIG. 5 is a generally elevational pictorial presentation similar to FIG. 1 but of alternate embodiment folding stool.

DETAILED DESCRIPTION

Referring to FIGS. 1 through 4 of the drawing, the stool 10 of the present invention comprises a pair of crossed members 12 and 14 wich are pivoted together to enable the stool to be folded. Member 12 comprises a light weight metal tubing, such as aluminum, which is bent into an inverted U shape to comprise a rail 16 at its upper end and a pair of integral legs 18 and 20 projecting downwardly from opposite ends of rail 16. In the stool 10, member 12 is inclined in a manner that rail 16 forms a rear edge of the top of the stool and legs 18 and 20 project both downwardly and forwardly.

Member 14 is formed of aluminum tubing bent into a trapezoidal shaped closed contour. Specifically, in member 14, there is a top rail 22, a pair of divergent arms 24 and 26 which project downwardly from opposite sides of rail 22 and a rail 28 interconnecting the lower extremes of arms 22 and 24.

The rail 28 is split at its center into two half sections **28*a* and 28*b* and a central gap 28*c* between the sections is closed by a bracket 36 welded to free ends of sections 28*a* and 28*b*. Rails 22 and 28 are parallel. Further, in stool 10, member 14 is inclined with rail 22 forming a forward top edge of the stool and being parallel to rail 16 and with the lower portion of member 14 extending downwardly and rearwardly to a position between legs 18 and 20. At that position, arms 24 and 26 are respectively pivoted to legs 18 and 20 with pins 30 and 32. Rail 28 lies below and rearward of pins 30 and 32.**

At the midpoint of rail 28 in gap **28*c*, a tubular guide 34 is fixedly secured to clamp 36 as lay welding. The guide 34 is inclined rearwardly and has a central bore for slideably receiving a tubular extendable levelling leg 38. Leg 38 has a plurality of apertures 40** in its wall spaced along the length of the leg.

A catch 42 is mounted on guide 34 about a pivot 44 carried thereby in a manner for the catch to be angulated relative to the axis of leg 38. One end of catch 42 carries an integral pin 46 projecting through an aperture 48 in the wall of guide 34. Pin 46 is of a length for projecting through aperture 48 and into a selected one of the apertures 40 which is aligned in register with aperture 48 and a spring 50 is provided to apply a torque urging pin 46 into the aperture 40. To disengage the pin 46 from an aperture 40, finger pressure is applied to a torque 52 on catch 42 on the other side of pivot 44 from pin 46. Then leg 38 is free to slide in guide 34 to select another aperture 40 to be engaged so as to adjust the effective length of the leg for levelling stool 10.

A generally planar pad 54 is provided rearwardly projecting from a bottom end of leg 38 for distributing the weight supported by the leg. Further, the top of stool 10 is formed by an elongated sheet 56 of flexible material which is securely wrapped at opposite ends about rails 16 and 22. Alternatively, sheet means in the form of a plurality of parallel strips 58 may be utilized as shown in FIG. 5.

FIG. 5 illustrates an alternate embodiment folding stool 60 wherein the member 14 is of a T shape including a leg 62 projecting downwardly and rearwardly from the midpoint of rail 22. Further, the member 12 has two arcuate legs 64 and 66 projecting downwardly and forwardly from opposite ends of rail 16. Legs 64 and 66 converge to a position where they lie against opposite sides of leg 62. At that position, a U shaped bracket 67 is welded about leg 62. The bracket 67 has a pair of projecting portions through which a pivot pin 68 is passed to pivotly mount legs 64 and 66 to leg 62. The lower ends of legs 64 and 66 diverge to about a 16 inch spacing at their free ends. Further, the leg 62 extends below and rearward of pin 68 and its lower end forms a guide portion 70 similar to guide 34 in which extendable leg 38 is telescopably received to enable levelling adjustment as in the embodiment of FIGS. 1 through 4. Guide portion 70 also carries a clasp member 42 which may operate essentially the same as in embodiment 10.

It will be appreciated that the stools 10 and 60 of the present invention may be easily set up and quickly levelled. While the preferred embodiments of the present invention have been described in specific detail, it should be noted that numerous modifications, additions and omissions in the details thereof are possible within the intended spirit and scope of the invention claimed herein.

What is claimed is:

1. A folding stool comprising: a first member of inverted U shape having a first rail and a pair of first legs projecting downward from opposite ends of said first rail; a second member of generally trapezoidal shape having a second rail directed parallel to said first rail; a pair of diverging arms projecting downward from opposite ends of said second rail to a position between said first legs; a third rail interconnecting the lower ends of said arms; said third rail being generally parallel to said second rail; pivot means at said position coupling said first legs to said pair of arms for relative rotation; an elongated flexible seat respectively secured at its opposite ends to said first and second rails; a generally tubular leveling leg having a plurality of apertures in its wall spaced apart along the length of said leveling leg; a guide carried at the mid-point of said third rail for slideably receiving said leveling leg; and means carried on said guide for engaging a selected one of said apertures.

* * * * *